US008074803B2

(12) United States Patent
Motsch et al.

(10) Patent No.: US 8,074,803 B2
(45) Date of Patent: Dec. 13, 2011

(54) FLEXIBLE PACKAGE WITH SIDE WALL TEAR OPENING MEANS

(75) Inventors: Andreas Peter Motsch, Waldems (DE); Matthew Aaron Neumann, Montgomery, OH (US); Ravi K. Saggar, Blue Ash, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 22 days.

(21) Appl. No.: 12/423,177

(22) Filed: Apr. 14, 2009

(65) Prior Publication Data

US 2009/0255847 A1 Oct. 15, 2009

(30) Foreign Application Priority Data

Apr. 14, 2008 (EP) ..... 08103520

(51) Int. Cl.
*B65D 73/00* (2006.01)
*B65D 65/28* (2006.01)

(52) U.S. Cl. ..... 206/494; 206/440; 383/10; 383/207

(58) Field of Classification Search ..... 206/233, 206/440, 494; 383/7, 10, 207, 8, 120
See application file for complete search history.

(56) References Cited

U.S. PATENT DOCUMENTS

| | | | | | |
|---|---|---|---|---|---|
| 4,890,934 | A * | 1/1990 | Feaver et al. | 383/10 |
| 4,934,535 | A * | 6/1990 | Muckenfuhs et al. | 206/494 |
| 5,036,978 | A * | 8/1991 | Frank et al. | 206/494 |
| 5,163,558 | A * | 11/1992 | Palumbo et al. | 206/494 |
| 5,219,229 | A * | 6/1993 | Sengewald | 383/207 |
| 5,464,285 | A * | 11/1995 | Anderson | 383/10 |
| 5,897,542 | A * | 4/1999 | Lash et al. | 604/378 |
| 7,168,563 | B2 * | 1/2007 | Zander et al. | 206/440 |
| 7,213,710 | B2 * | 5/2007 | Cotert | 206/494 |
| 7,866,473 | B2 * | 1/2011 | Clark et al. | 206/494 |
| 2002/0112982 | A1 * | 8/2002 | Stagray et al. | 206/494 |
| 2006/0021894 | A1 | 2/2006 | Clark et al. | |

FOREIGN PATENT DOCUMENTS

| | | |
|---|---|---|
| WO | WO-91/08962 A1 | 6/1991 |
| WO | WO-95/08491 A1 | 3/1995 |

OTHER PUBLICATIONS

International Search Report.

* cited by examiner

*Primary Examiner* — Bryon Gehman
(74) *Attorney, Agent, or Firm* — William E. Gallagher

(57) ABSTRACT

A flexible package for accommodating a multiplicity of articles, wherein the package comprises at least a side wall with an aperture defined by an aperture edge. The aperture provides a structure for gripping and for tearing away a tear-away portion of the side wall, defined by lines of weakness. The tearaway portion is adapted to create an opening in the side wall through which articles may be removed from the package. The package further includes a strap adjacent to an upper edge of the side wall and defined in part by a upper portion of the aperture edge.

9 Claims, 8 Drawing Sheets

FLEXIBLE PACKAGE WITH SIDE WALL TEAR OPENING MEANS

FIELD OF THE INVENTION

The object of the application relates to a package suitable as a flexible wrapping especially for diapers that are placed in the package in a consolidated form in one or more series. An opening can be made in at least one side wall of the package for individual removal of the package contents.

BACKGROUND OF THE INVENTION

A flexible package with an opening feature is disclosed e.g. in US 2006/0021894 A1. The opening feature is facilitated in a side wall and, upon opening, provides access to the articles contained in the package. The opening can be initiated by using an aperture. The package will tear open along lines of weakness. The lines of weakness extend to an upper edge of the package, while the aperture is arranged somewhat below this edge. Upon opening, the complete aperture is torn downwardly.

One of the disadvantages associated with this package is that it can accidentally tear if it is lifted at the external panel of a gusset. Moreover, the contents contained in the package will easily fall out of the package upon opening, as the opening provided is relatively large.

It is an objective of the present invention, to provide an opening feature for a flexible package, which does not open inadvertently.

It is a further objective of the present invention to provide a package with an opening feature where the articles or parts of the articles contained in the package do not fall out of the package after opening but are contained in the package. For example, if the articles are a multiplicity of diapers, the diapers should be retained in the package after opening.

SUMMARY OF THE INVENTION

The present invention provides a flexible package being adapted to contain a multiplicity of articles. The package comprises at least a side wall having a side seam, the side wall having further an upper edge and a lower edge, wherein at least one gusset is formed in the side wall.

The at least one gusset comprises an internal panel covered by an external panel, the external panel comprising an upper edge lying adjacent the upper edge of the side wall. The upper edge of the external panel extends over the whole width of the side wall. The side wall comprises an opening means, the opening means comprising gripping means and tearing means. The gripping means is formed in the external panel, wherein the opening means is adapted to create an opening in the side wall by tearing a tear-off portion of the side wall.

One or more articles from the multiplicity of articles can be removed from the package through the opening, wherein the external panel further comprises a first strap extending from an upper edge of the gripping means to the upper edge of the external panel, the first strap extending over the whole width of the external panel.

After forming the opening, the upper edge of the external panel and the first strap remain adjacent to the upper edge of the package.

It is a further object of the invention to provide a method of manufacturing a flexible package comprising at least one gusset in at least one side wall. The at least one gusset comprises an internal panel, which is covered by an external panel, wherein an upper edge of the external panel extends over the whole width of the side wall and wherein the side wall comprises an opening means having gripping means, the gripping means being formed in the external panel. The method comprises the steps of:

Providing an endless sheet travelling in a machine direction and comprising in cross machine direction a twofold portion and a fourfold portion, the twofold portion comprising two layers and the fourfold portion comprising four layers, wherein the outer layers of the fourfold portion are coextensive with the two layers of the twofold portion.

Further, a structural weakening is introduced into the fourfold portion at a distance from an upper side edge of the fourfold portion, whereby the structural weakening forming the gripping means.

Finally all layers of the twofold and fourfold portion are cut and seamed along a seam extending along cross machine direction and traversing the structural weakening.

BRIEF DESCRIPTION OF THE DRAWINGS

While the specification concludes with claims pointing out and distinctly claiming the present invention, it is believed the same will be better understood by the following drawings taken in conjunction with the accompanying specification wherein like components are given the same reference number.

DETAILED DESCRIPTION OF THE INVENTION

Figure 1:
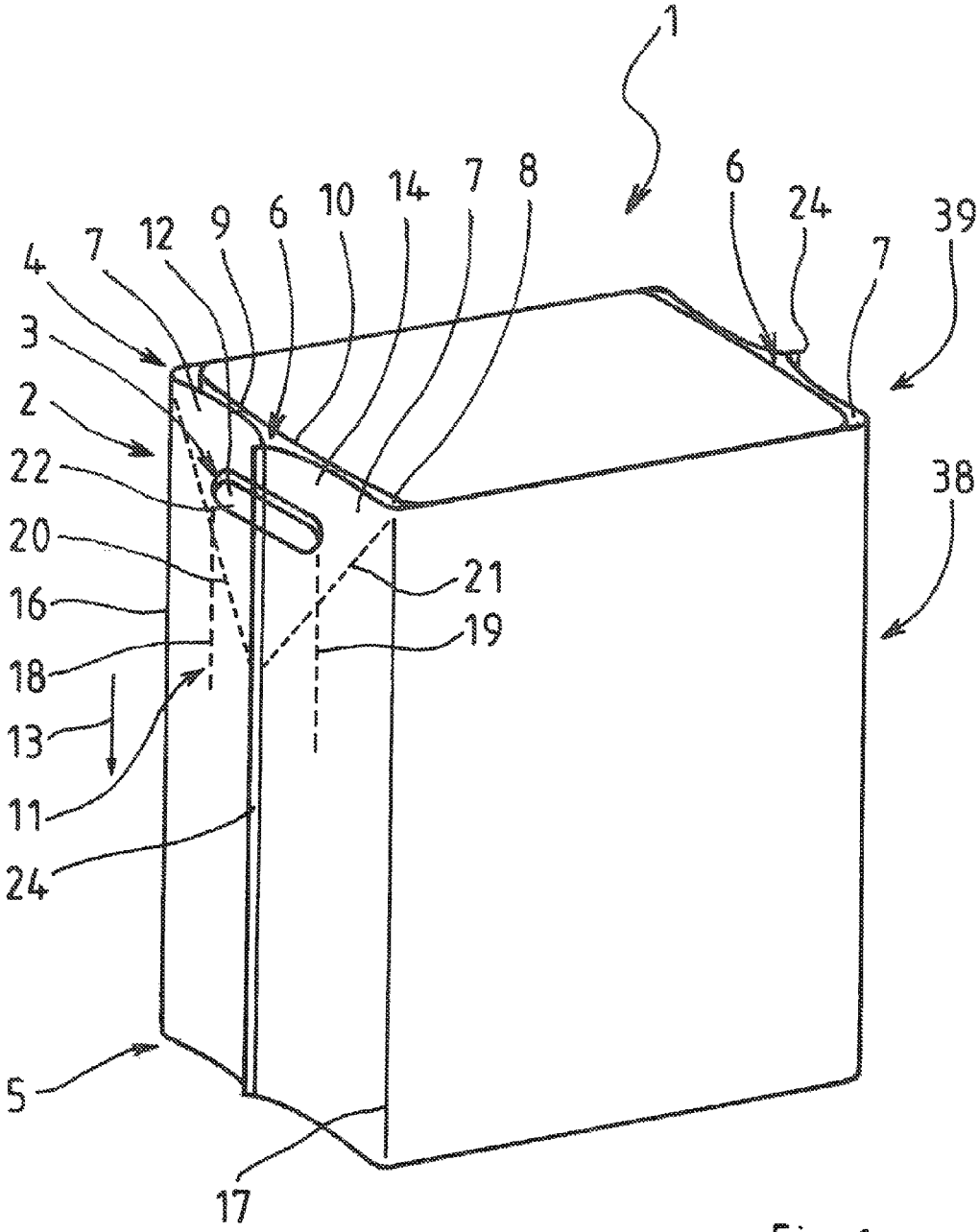
FIG. 1 in a perspective view, a foil package containing a series of diapers, with a side wall comprising opening means having a line of weakness along a tearing-off direction and comprising a perforated tongue for gripping and opening a part of the wall directly underneath a strap.

"Diaper" as used herein refers to absorbent articles generally worn by infants and incontinent persons about the lower torso. The diaper may be fastened onto the wearer using tapes or, alternatively, the diaper may have side seams, which are fastened together—both permanently or refastenably—such that the diaper is applied onto the wear like a conventional underwear (i.e., the user will put his legs through the respective leg openings and the diaper is then pulled up to its final position).

"Comprise," "comprising," and "comprises" is an open ended term that specifies the presence of what follows, e.g. a component but does not preclude the presence of other features, elements, steps or components known in the art, or disclosed herein. However, the presence of additional other features, elements, steps or components is not required at the terms "comprise" "comprising," and "comprises" thus also encompasses the terms "consisting of" and "essentially consisting of".

The flexible package of the present invention may be rectangular, and may comprise thermoplastic material. Further, the flexible package comprises a plurality of walls, typically two opposing side walls, 2, 38 a front wall and a back wall and a top wall and a bottom wall.

Each side wall 2 has an upper edge 4 lying adjacent the top wall and a lower edge 5 lying adjacent the bottom wall of the package. Each side wall 2 also has two opposing side edges 16, 17 lying adjacent the front and back wall of the package, respectively.

The material of the filled package 1 is folded over from the front and back wall to the side walls 2 of the package. Also, the material at least from the top wall is folded over to the side walls. However, also the material from the bottom wall may be folded over to the side wall 2. A seam 24 is formed in the side walls 2 to provide a closed package 1. The seam 24 is essentially extending from the upper edge 4 of the side wall 2 towards the lower edge 5 of the side wall 2. Moreover, at least one gusset 6 is formed in each side wall 2 adjacent the upper edge 4 of each side wall. Each gusset comprises an internal panel 8 which is overlaid by an external panel 7. The internal panel 8 and the external panel 7 have the same dimensions and the same shape.

Figure 5:
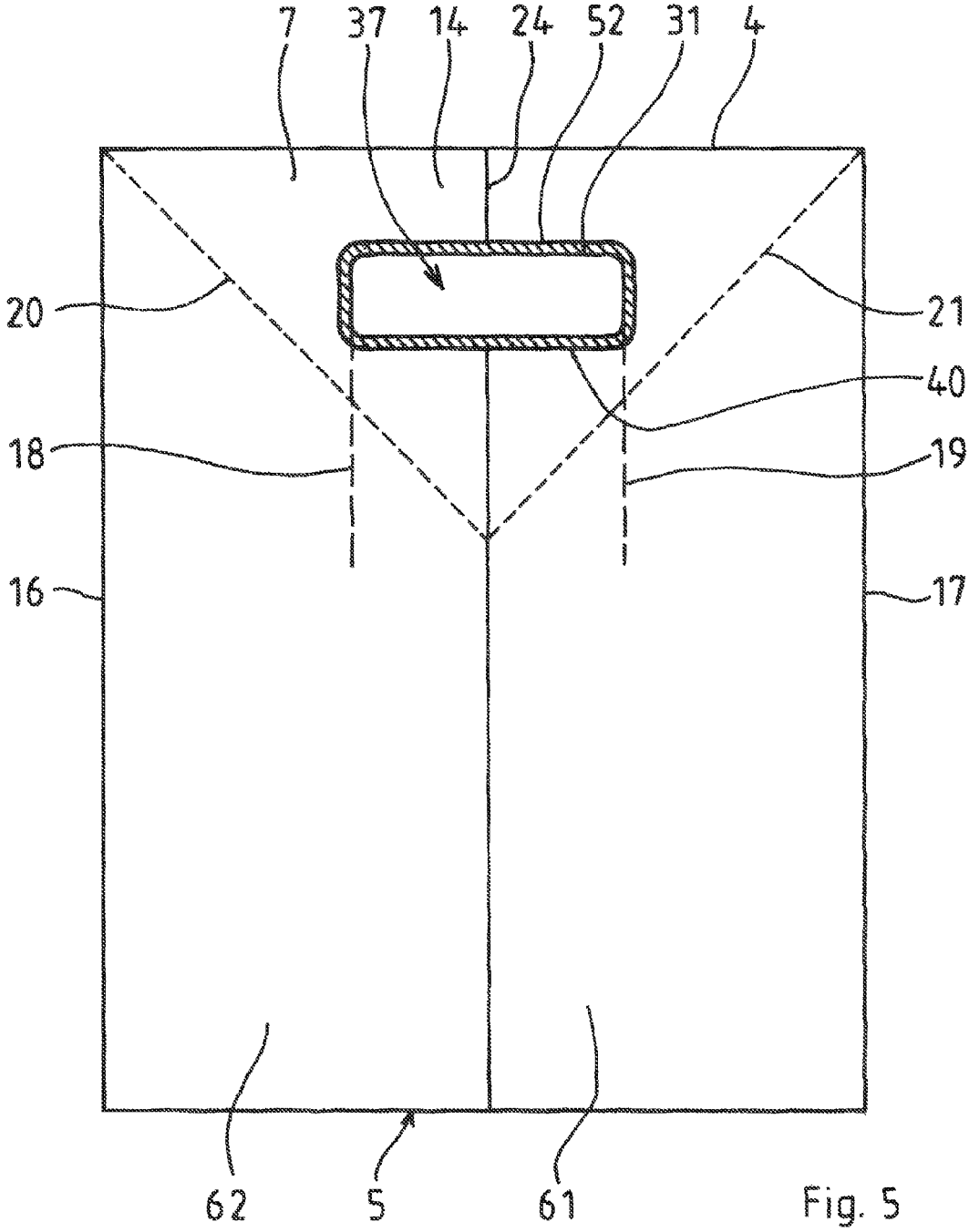
FIG. 5 in a side view, another embodiment of the package comprising a reinforced aperture as gripping means.

Typically, the gusset 6 is shaped in the form of a triangle formed by the upper edge 4 and two fold lines 20, 21 as exemplary indicated in FIGS. 1 and 5. A pocket formed by the gusset 6 comprises an internal panel 8 and an overlapping external panel 7, wherein the external panel 7 comprises two layers of material. The external panel 7 comprises an upper edge 9 lying adjacent the upper edge 4 of the side wall 2 and lying adjacent the upper edge 10 of the internal panel 8. Hence, the upper edge 9 of the gusset is coextensive with the upper edge 4 of the side wall 2. A typical package 1 of the present invention is for example shown in FIG. 1.

The flexible package 1 may comprise a multiplicity of articles 33, 34. For example, the package 1 of the present invention may be used for accommodating a multiplicity of diapers. The diapers 33, 34 may be folded and the multiplicity of folded diapers may be arranged in one or more rows within the package.

A diaper typically has a longitudinal axis and a transverse axis. One end portion of the diaper is configured as a front waist region of the diaper. The opposite end portion is configured as a back waist region of the diaper. An intermediate portion of the diaper is configured as a crotch region, which extends longitudinally between the front and back waist regions. The crotch region is that portion of the diaper which, when the diaper is worn, is generally positioned between the wearer's legs. Further, the transverse axis is typically in the crotch region of the diaper.

In a two-folded diaper, the diaper is folded in the crotch region along its transverse axis or near its transverse axis. In the folded diaper, the front waist region is lying adjacent the back waist region and the front and back waist region are substantially coextensive.

Alternatively, the diaper may be tri-folded, whereby one of the front or back waist region is folded over onto the crotch region where after the remaining waist region is folded over onto the first folded waist region.

The folded diaper comprises two major surfaces. E.g. in a two-folded diaper, the first major surface comprises the front waist region of the diaper and a portion of the crotch region, while the second major surface comprises the back waist region of the diaper and the remaining portion of the crotch portion. However, also a tri-folded diaper has two major surfaces. When placed into the flexible package, the major surfaces should face towards the side walls 2 of the package 1.

If the package 1 comprises more than one row of diapers, the diapers should be arranged such that in each row, major surfaces 33, 34 face towards the side walls 2 of the package.

Also, the folded diapers arranged in the package 1 have an upper part lying towards the top wall of the package and a lower part lying towards the bottom wall.

At least one of the two side walls 2 comprises opening means 3 for assisting in opening the package 1. The opening means 3 comprising gripping means 12 and tearing means 11.

The gripping means 12 are formed through or in the external panel 7. The gripping means 12 may take any shape and have any configuration (i.e. aperture, perforation, slit etc.) as long as it is ensured, that one or more fingers of a person fit through the gripping means 12 to allow lifting the package 1. The gripping means 12 may be formed as an aperture 37. Alternatively, the gripping means 12 may be formed as a slit in the external panel 7, i.e., without removing any material when forming the gripping means 12.

Alternatively, the gripping means 12 can be formed as a weakened area, such as a perforation, being transformed into a slit when a user, intending to lift the package, is gripping through the pocket or gusset 6 with his fingers, thereby at least partially breaking the perforation. In these embodiments, the one or more fingers of a person of course only have to fit through the gripping means 12 after the perforation has been broken. When the gripping means 12 are formed as an aperture 37, as e.g. illustrated in FIG. 5, the shape of the aperture may be rectangular, oval or even round. Alternatively, the shape of the aperture 37 may take any other, even slit like shape.

The external panel 7 further comprises a first strap 14, which is the part of the external panel 7 above the gripping means 12, i.e. the part extending in width from an upper edge 31 of the gripping means 12 to the upper edge 9 of the external panel 7. The strap 14 can be grasped manually from below in order to lift the package 1.

Furthermore, the strap 14 may also be grasped from above to lift the package. Hence, the user may enter with his finger(s) into the pocket or gusset 6 from the upper edge 4 between the internal 8 and the external panel 7. As the fingertips proceed they may reach through or may penetrate the external panel 7 in the region of the gripping means 12 being designed as aperture or alternative, as a weakening to be broken upon a first gripping.

In any gripping manner, the hand of the user is clasped around the first strap 14 allowing for an easy and intuitive raising and transporting of the package 1. The strap 14 takes up the force manually applied and added directly above the gripping means. When a package is lifted up, the strap 14 provides sufficient resistance to transfer the force to the rest of the package 1 without tearing the strap 14. Thus unintentional opening of the package 1 can be effectively prevented.

The opening means 3 can be utilized to create an opening 25 in the side wall 2, wherein individual articles 33, 34, such as diapers from the multiplicity of articles can be removed through the opening 25. To facilitate the opening, a part of the side wall, i.e. a tear-off strip 23 can be torn away. In the illustrated embodiments, the tearing-off motion 13 may be directed downwards to the lower edge 5 of the side wall 2. The opening 25 can also extend to other walls of the package 1. In these embodiments, a part of a tear-off portion 23 extends to one or more other walls of the package 1. Typically, the opening 25 is only comprised by the side wall 2.

However, the first strap 14 does not contribute to the opening 25. Thus, the first strap 14 and its function is nearly not affected by the tearing open of the package 1, i.e. the first strap 14 is not comprised by the tear-off portion 23. Instead, the first strap 14 is located outside that part 23 of the side wall 2 being torn away or being torn down upon opening of the package 1. Therefore, even after the package 1 has been opened, the first strap 14 can still be used to assist in lifting or transporting the package 1.

The width of the first strap 14 extending from the upper edge of 31 the gripping means 12 to the upper edge 9 of the gusset 6 may range from 10 mm to 50 mm. These dimensions allow for convenient carrying and ensure that the first strap 14 does not tear apart upon lifting.

The gripping means 12 may have an upper edge 31, which also forms a lower edge 31 of the first strap 14. This upper edge 31 is facing towards the upper edge 4 of the side wall 2.

Figure 4:
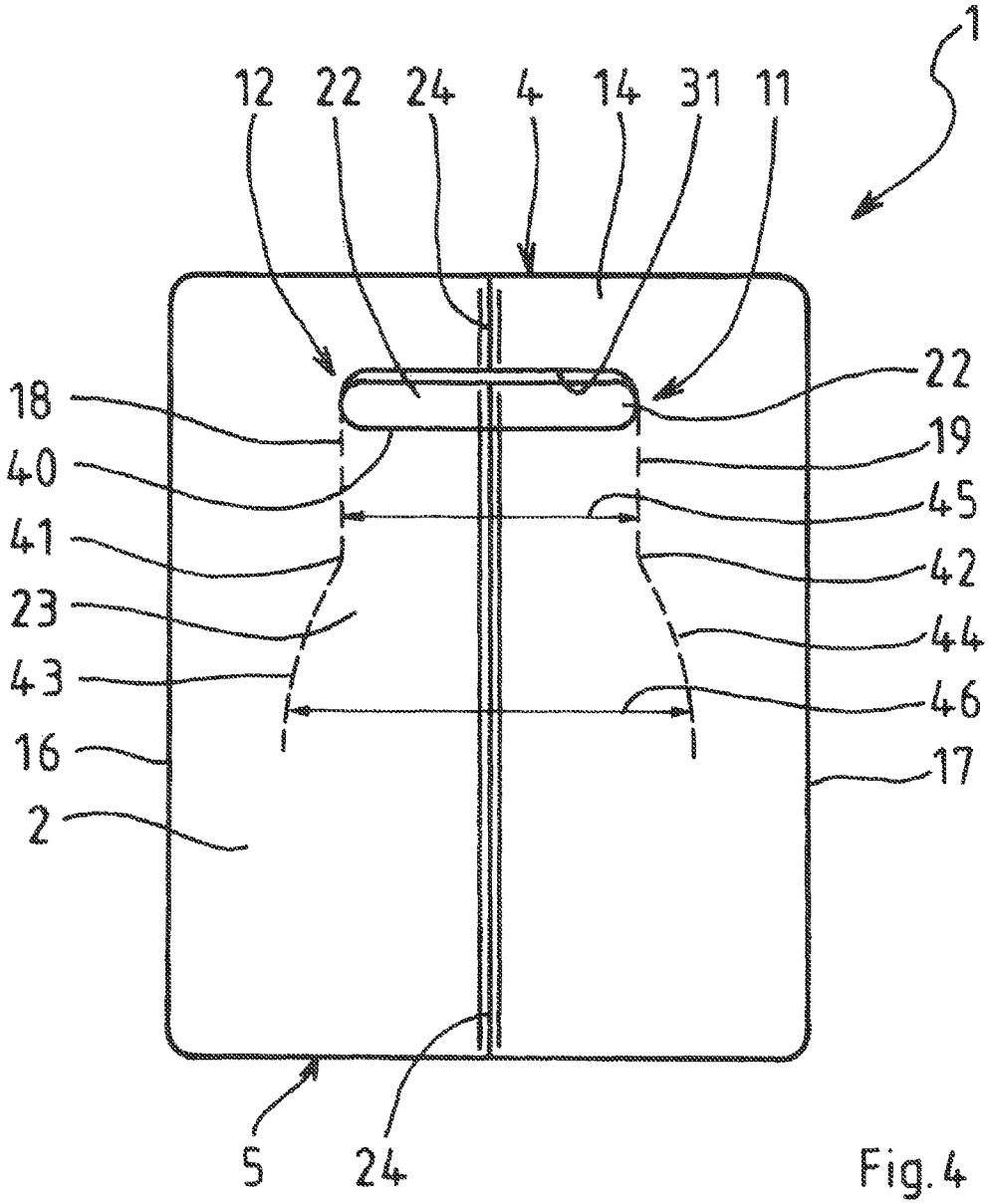
FIG. 4 in a side view, the package according to FIG. 3 with tearing means being designed as a perforation having two zigzags.

The gripping means 12, as illustrated in FIGS. 4 and 5, may also have a lower edge 40, which is facing towards the lower edge 5 of the side wall 2. The lower edge 40 of the gripping means 12 is associated with the tear-off portion 23 which is torn away, for example towards the lower edge 5 of the side wall 2. The upper edge 31 of the gripping means 12 is associated to the first strap 14 even after opening of the package 1. Thus, upon opening, the gripping means 12 is disassembled. In the opened package, the gripping means 12 in its complete form including all upper and lower boundary edges 31, 40 is no longer present.

As said above, the gripping means 12 is formed through or in the external panel 7 of the gusset 6. Hence, a portion of the pocket, which is covered by the gusset 6, extends from the lower edge 40 of the gripping means 12 towards the lower edge 5 of the side wall 2. If the pocket takes the form of a triangle, the portion of the pocket extending from the lower edge 40 of the gripping means 12 downwards will also take the form of a, however smaller, triangle. This smaller triangle can be used to slit at least a part of a user's finger into, which helps in tearing open the package 1 along the lines of weakness 18, 19, which are explained in detail below.

The tearing means 11 may comprise a line of weakness 18, 19. The line of weakness may comprise a first portion 18 and a second portion 19 being spaced apart from each other. The first portion 18 of the line of weakness specifies a left side border of the tear-off portion or tear-off strip 23, whereas the second portion 19 of the line of weakness specifies a right side border of the tear-off portion 23. Both portions 18 and 19 extend from the gripping means 12. For example, the first and second portions 18, 19 extend towards the lower edge 5 of the side wall 2. However, the first and second portions 18, 19 may also extend into one or more other walls, e.g. front wall, back wall, top wall or bottom wall comprised by the package.

A third portion 47 of the line of weakness extends within the pocket at the internal panel 8 of the gusset 6 and connects the first and second portion 18, 19 of the line of weakness.

When the package 1 is torn open along the line of weakness 18, 19 the portion of the internal panel 8 extending above the third portion 37 of the line of weakness towards the upper edge 4 of the first side wall 2 may form a second strap 15. The second strap 15 may be essentially coextensive with the first strap 14. However, the second strap 15 may have a smaller or a larger width than the first strap 14. Furthermore, the second strap is formed in the inner panel 8 of the gusset 6. It is confined by the two oppositely arranged fold lines 20, 21 to the left and to the right. When the package 1 is still closed, the lower edge 26 of the second strap 15 is adjacent the upper edge 28 of the e.g. triangle-shaped pocket portion 32 of the tear-off portion 23 of the side wall 2. The two corresponding edges 26 and 28 are mutually connected by means of the third portion 47 of the line of weakness, which is illustrated in the unfolded configuration of FIG. 7.

After opening, parts of the remaining side wall, which have not been torn away to create the opening 25, may extend from the first and second portions 18, 19 of the line of weakness, respectively, to the side edges 16, 17 of the side wall 2. One part may extend outwardly from the first portion of the line of weakness 18 to one side edge 16 of the side wall 2 and another part may extend outwardly from the second portion of the line of weakness 19 to the opposite side edge 17 of the side wall 2. The first and the optional second strap 14, 15 connect the two side parts above the opening 25 between the two lateral side wall parts. The external panel forms the first, outer strap 14 and the internal panel 8 forms the optional second, inner strap 15.

The first and the optional second straps 14, 15 in conjunction with those parts of the side wall 2 extending from the different portions of the line of weaknesses 18, 19 towards the respective side edges 16, 17 form a kind of frame. This frame provides a means to retain the outer shape of the package even after opening. The first and the optional second straps 14, 15 may be essentially coextensive.

Further, from a topological point of view, the first strap 14 extends into the second strap 15 across the lateral fold lines 20, 21.

Also, after opening, the frame helps to ensure, that the articles 33, 34 comprised in the package 1 remain within the package 1 and do not fall out. The upper part of the articles, e.g. the diapers 33, 34, is maintained in the package 1 by the frame. However, it may also be sufficient to ensure, that the articles 33, 34 are maintained in the package 1 by having only the first strap 14. In such embodiments, the left and right, first and second portions 18, 19 of the line of weakness may extend substantially along the side edges 16, 17 and the third portion 47 of the line of weakness 18 may extend along the upper edge 4 of the side wall 2. Thus, almost the complete side wall may be torn away in order to create the opening 25. However, embodiments having a frame as explained above are preferred.

The spacing between the first 18 and second portion 19 of the line of weakness depends on the size of the articles 33, 34 to be disposed in the flexible package 1. Also, if for example the package 1 comprises a multiplicity of folded diapers 33, 34, the size of the opening 25 will also depend on the number of diaper rows 35, 36 comprised in the package 1. If the package 1 comprises only one row of diapers 33, 34, the spacing between the first 18 and second portion 19 of the line of weakness will typically be smaller compared to a package 1 comprising two rows 35, 36 of diapers arranged next to each other. After opening the package 1, the first diaper of each row 35, 36 directly faces towards the opening 25 with one of its major surfaces.

The package 1 of the present invention may also contain 4 rows of articles, such as diapers. In those embodiments, two rows are arranged with one of their side portions next to each other while two more rows are arranged similarly below the first pair of rows. In these embodiments, the tear-off portion 23 and associated first and second portion 43, 44 of the line of weakness 18 may extend further downward towards the lower edge 5 of the package 1. In these embodiments, a smaller opening 25 may be torn open first to have access to the upper two rows of diapers. After the upper two rows of diapers have been used up, the opening can be enlarged or extended by using the first and second portion 43, 44 of the line of weakness 18 along their complete length. In this manner, the lower two rows of diapers are securely held within the package upon using the upper two rows of diapers. Alternatively, a package 1 containing four rows of diapers may comprise two separate lines of weaknesses 18, wherein the upper line of weakness is associated with the gripping means 12. The lower line of weakness is independent from the gripping means 12 and also independent from the upper line of weakness 12.

If the package comprises only one row of diapers, the spacing between the first 18 and second portion 19 of the line of weakness may be smaller than the width of the article's major surface facing towards the opening 25. In this embodiment, after opening the package 1 along the line of weakness 18, 19, one of the diaper's major surfaces faces towards the opening 25 and the side portions of the diaper's major surface may be retained in the package 1 by the parts of the side wall 2 extending from the first 18 and second portions 19 of the line of weakness to the side edges 16, 17 of the side wall 2, respectively.

If the package comprises two rows 35, 36 of diapers 33, 34, the spacing between the first 18 and second portion 19 of the line of weakness may typically be smaller than the width of both rows 35, 36 of diapers taken together. However, the spacing between the first 18 and the second portion 19 of the line of weakness may be wider than the width of a major surface of a diaper. In this embodiment, after opening the package 1 along the line of weakness 18, 19, the side portion of the diaper's major surface lying adjacent the side edge of the side wall 2 and facing towards the opening 25 may be retained in the package 1 by the part of the side wall 2 extending from the first 18 or second portion 19 of the line of weakness to one of the side edges 16, 17 of the side wall 2.

However, the other side portion of the diaper's major surface lying adjacent the diaper 33, 34 of the neighbouring row 35, 36 of diapers may be retained in the package 1 mainly due to friction forces between the diapers of neighbouring rows 35, 36.

In the package 1 of the present invention, the two oppositely arranged side walls 2, 38 may comprise gripping means 12, 39 being formed in or through the external panel 7 comprised by the gusset 6 of the respective side wall 2, 38. The two gripping means may be configured to be identical in shape or may be different from each other, e.g. one gripping means may be configured as an aperture while the second one may be configured as a slit; or the gripping means may take different shapes. Alternatively, the second gripping means may not be comprised by the opposite side wall but may be configured as a handle associated with the top wall of the package 1. However, two gripping means may enable easier carrying of the package, especially for relatively large aid/or relatively heavy packages 1. However, typically only one side wall 2 will comprise tearing means 11 and opening means 3.

The opening 25 formed in the first side wall 2 may be somewhat narrower in an upper area. This helps retaining the upper part of the diapers within the package after opening. A lower area of the opening may be wider to make it easier to grasp a diaper 33, 34 and to pull it out of the opening 25.

As illustrated in the embodiment of FIG. 4, the spacing between the first and second portion 18, 19 of the line of weakness may have a first distance 45 along a first, upper section, wherein this upper section extends from the gripping means 12 towards a bend or curvature 41, 42. Between their lower sections 43, 44 extending further away from the gripping means 12, for instance towards the lower edge 5 of the side wall 2, the portions of the line of weakness 18, 19 may have a second distance 46. The first distance 45 may be smaller compared to the second distance 46. Thereby, the upper parts of diapers 33, 34 contained in the package 1 are prevented from falling out of the package because they are kept within the package 1 at least by the first strap 14 and the remaining side wall extending from the first section 18, 19 of the line of weakness to the respective side edges of the side wall 16, 17.

Hence, along the upper first sections 18, 19 of the line of weakness, the opening 25 is somewhat narrower compared to the lower second sections 43, 44 of the line of weakness.

Those parts of the articles 33, 34 lying adjacent the second sections 43, 44 in the package 1 may more easily bulge out through the opening 25 in the area of the second section 43, 44. Thus, it is easier for a consumer to grip the article (e.g. a folded diaper 33, 34) upon opening the package 1. The article (e.g. the folded diaper 33, 34) lying closest to the opening 25 can be easily taken by the consumer in the area of the article (e.g. the folded diaper 33, 34), which has bulged out of the opening 25. Alternatively, the first article (e.g. the first folded diaper 33, 34) and one or more of the following articles (e.g. folded diapers) may be taken out together, provided that the second distance 46 allows more than one article (e.g. folded diaper) of the row to bulge out of the opening.

Also in embodiments wherein the package 1 comprises only one row 35, 36 of articles such as diapers 33, 34, wherein the spacing between the first 18 and second portion 19 of the line of weakness each comprises a first 18, 19 and a second section 43, 44 as described above, the second distance 46 may be smaller than the width of the article's major surface facing towards the opening 25. The first distance 45 will then apparently also be smaller than the width of the article's major surface facing towards the opening 25.

If the package 1 comprises two rows 35, 36 of diapers 33, 34, and the line of weakness each comprises a first 18, 19 and a second section 43, 44 as described above, the second distance 46 will be smaller than the width of both rows 35, 36 taken together. However, the second distance 46 may be wider than the width of a major surface of a diaper.

The way the gusset 6 is configured in the side walls 2, 38, is well known in the art. The external panel 7 comprises two layers, an inner layer and an outer layer. In order to reinforce the gripping means 12, the inner and the outer layers of the external panel 7 may be reinforced adjacent the edges 31, 40 of the gripping means 12. The structure of reinforcement may be introduced by bonding, joining or connecting the inner and outer layer of the external panel 7 along the intended structure.

Such a reinforced structure 52 is for example illustrated in FIG. 5. Here, the gripping means 12 comprises an aperture 37 being executed as a cutaway of material over a region of approximately rectangular shape. This aperture 37 is surrounded by a closed structure of reinforcement 52. However, the reinforcement structure 52 is not confined to such embodiments, wherein the gripping means 12 is an aperture 37, but the gripping means can also be facilitated in any other way as described above.

It may be desirable to reinforce the inner and outer layers only adjacent the upper edge 31 of the gripping means 12. In particular, it may be desirable to reinforce the layers in the lower area of the first strap 14 being adjacent the upper edge of the gripping means 12, since upon lifting up the package 1, the first strap 14 will typically experience the major strain compared to the gripping means 12.

To reinforce the external panel 7 in the vicinity of the gripping means 12, the inner and outer layer may be bonded to each other adjacent the complete upper 31 and/or lower edge 40 of the gripping means 12. Alternatively, the inner and outer layer may be bonded to each other at least adjacent the upper edge 31 of the gripping means 12 or may be bonded to each other only adjacent the lower edge 40 of the gripping means 12.

The bonding of the inner and outer layer can be achieved e.g. by adhesive bonding, pressure bonding as well as by means of thermal bonding or ultrasonic bonding, especially if the flexible package is made of thermoplastic material. Furthermore, other suitable bonding means known in the art are also within the scope of this invention. The bonding of the inner and outer layers can be done intermittently adjacent the edges of the gripping means 12 or can be executed as a continuous bonding line extending adjacent the upper and/or lower edge 31 of the gripping means 12.

Figure 6:
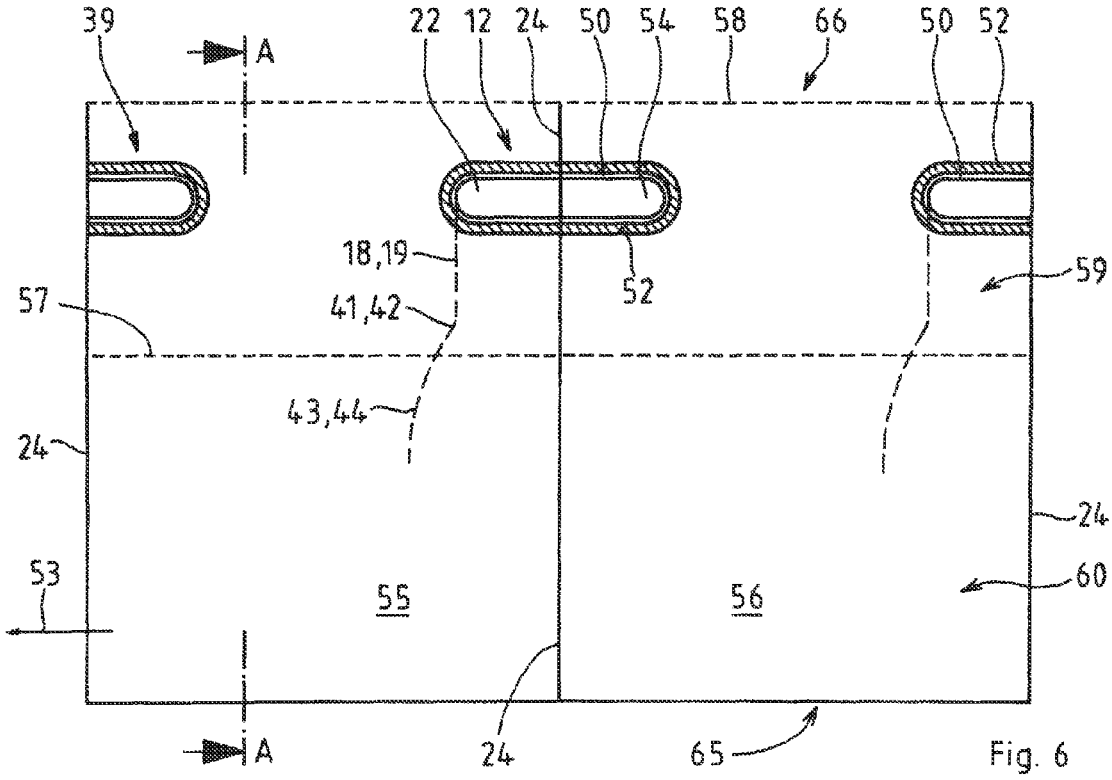
FIG. 6 in a front view, two packages during manufacture from an endless sheet.
Figure 7:
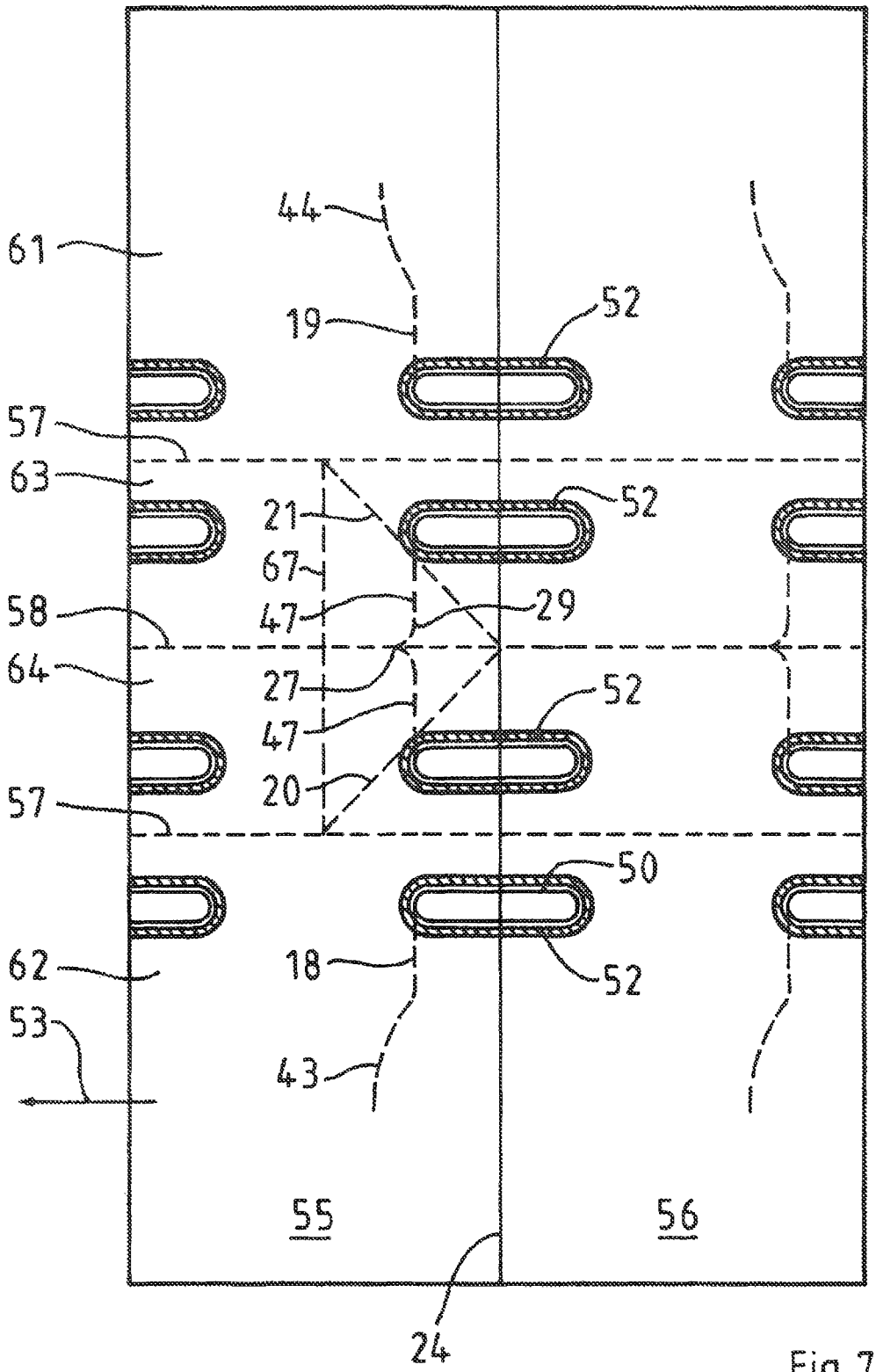
FIG. 7 a schematic illustration of the two packages according to FIG. 6 in an unfolded configuration.
Figure 8:
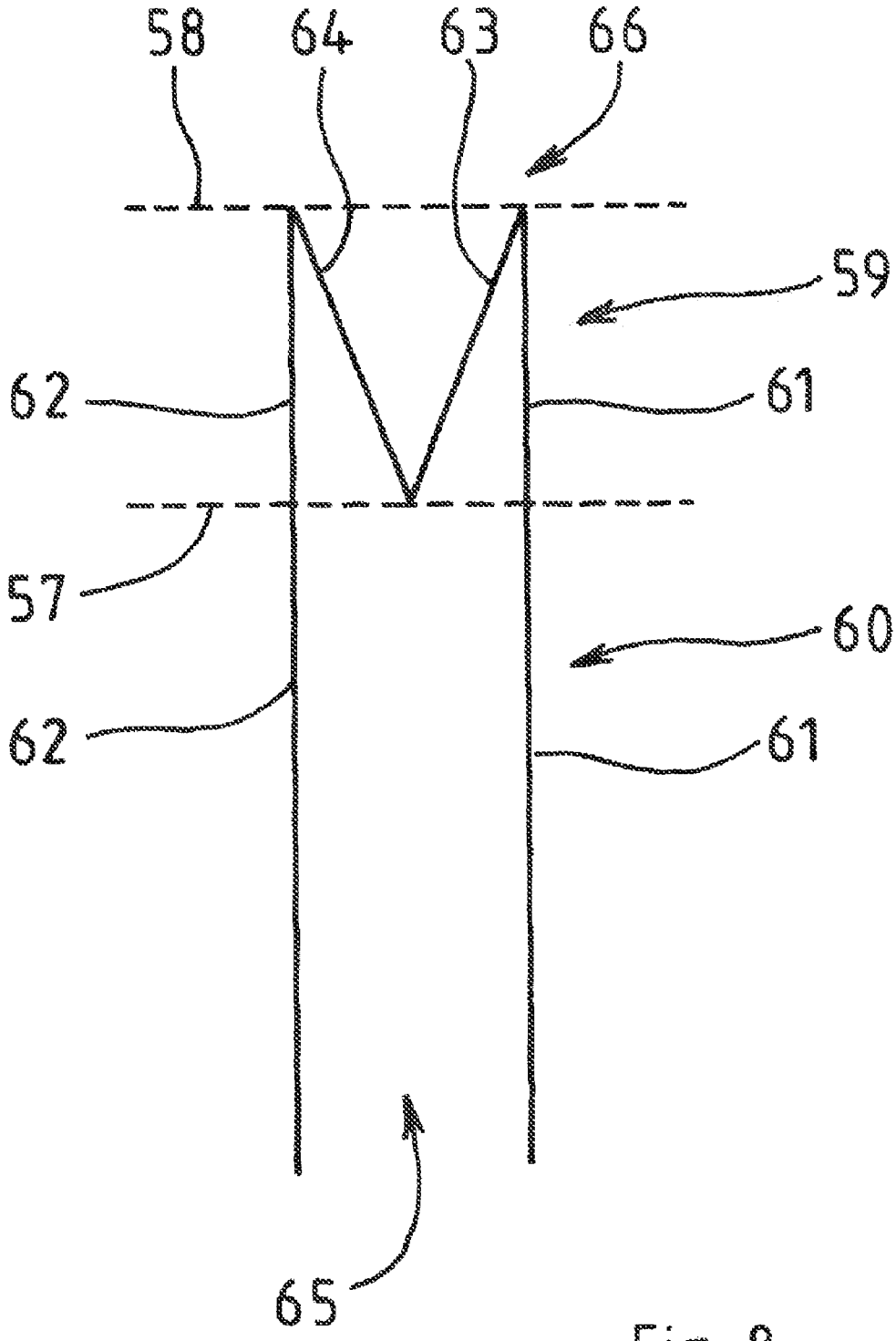
FIG. 8 a schematic illustration of various layers of the endless sheet according to FIG. 5 as seen along a cross section A-A.

FIGS. 6 through 8, schematically illustrate a possible way of manufacturing the flexible package 1. Manufacture of the package 1 starts from a panel comprising an endless sheet travelling in machine direction (MD) 53. The sheet as illustrated in FIG. 6 and shown in cross section along A-A in FIG. 8 is folded multiple times in such a way, that the folded sheet, in machine direction 53, comprises a twofold portion 60 and a fourfold portion 59. The fold lines 57, 58 extend in machine direction 53 along the endless sheet. In cross machine direction (CD), the sheet has lateral edges 65 and 66. The fold line 58 forms an upper lateral edge 66 of the folded sheet, whereas the other fold line 57 separates the twofold portion 60 and the fourfold portion 59. The folded sheet further has a lower lateral edge 65, which is at the twofold portion 60. The lower lateral edge 65 of the twofold portion 60 later on forms at least a part of the bottom wall of the package 1, whereas the lateral edge 66 of the fourfold portion 48 overlapping with the fold line 58 forms a portion of the top wall of the package 1.

The fourfold portion 59 of the M-shaped folded sheet comprises two outer layers 61, 62, being coextensive with the two layers 61, 62 of the twofold portion 60. Sandwiched between the two outer layers 61, 62, the fourfold portion 59 further comprises two inner layers 63, 64 disposed adjacently in an overlaying manner. The two inner layers 63, 64 as well as the two outer layers 61, 62 are portions of the folded endless sheet. The inner layers 63 and 64 mutually merge at the fold line 57 and each inner layer 63, 64 merges into the adjacent outer layer 61, 62 at the fold line 58.

By comparison of FIGS. 6 and 8, the horizontally extending fold lines 57 and 58 in FIG. 6 are also horizontally arranged in the cross sectional illustration of FIG. 8. By way of illustration, in this cross sectional view, the various portions of the endless sheet form a kind of M-shaped fold. The various layers 61, 62, 63, 64 are folded over onto themselves along fold lines 57 and 58. According to the method of the present invention, the layers 61, 62, 63, 64 lie flat on top of one another.

After having folded the endless sheet to an M-shaped fold comprising a twofold portion 60 and a fourfold portion 59, at least one structural weakening 50 is introduced through or in the fourfold portion 59. This structural weakening 50 corresponds to the gripping means 12 of the package 1. The structural weakening 50 can be implemented as a perforation, a zigzag-structure or as a partial or complete cut or slit in the material of the fourfold portion 59. The structural weakening 50 may also be implemented as an incomplete cutout in the fourfold portion 59, such, that a tongue-like portion 22, 54 may be obtained. Also, the structural weakening can be provided as an aperture 37 of various, for instance, rectangular, oval, circular or polygonal shape.

After introducing the structural weakening 50, all layers 61, 62, 63, 64 of the sheet are sealed and cut along a seam 24 running substantially in cross machine direction. The seam 24 further splits and divides the structural weakening 50. Typically, the sealing and cutting is performed simultaneously by means of a combined seaming and cutting stage. By means of the sealing, all layers 61, 62, 63, 64 of the sheet become inherently provided with a side seam 24 connecting in one step the two layers 61, 62 of the twofold portion 60 as well as all four layers 61, 62, 63, 64 of the fourfold portion 60. The seam 24 extends substantially in cross machine direction 53 and perpendicular to the fold lines 57, 58. Forming of the seam 24 as well as cutting or disassembling of adjacent packages 55, 56 is typically performed in a single step by means of a convenient seaming and cutting apparatus.

In comparison of FIGS. 5, 6 and 8, the sealing of the various layers 61, 62, 63, 64 and their final arrangement in the package 1 becomes apparent. The vertically elongated seam 24 connects the two outer layers 61, 62 in the area, where the two outer layers form left and right side portions of the side wall 2 of the package 1. Furthermore, the seam 24 is also bonding the two inner layers 63, 64. With respect to FIG. 1, these portions of the inner layers 63, 64 later on form the inner layer of the external panel 7, whereas portions of the outer layers 61, 62 form the outer layer of the external panel 7. The internal panel 8 and the second strap 15 are entirely formed by the internal layers 63, 64.

The structural weakening 50 being introduced into all four layers 61, 62, 63, 64 of the fourfold portion 59 in FIG. 5 has a closed oval shape being disassembled by the seam 24. The inner portion of that oval, no matter on whether it is provided as an aperture, as a slit or as tongue-like portion is divided into a portion 22 and a portion 54, being adjacently located to the left and to the right of the seam 24. Since both outer layers 61, 62 and both inner layers 63, 64 are equally provided with said structural weakening 50, by unfolding each package 55, 56 separately, the semi-oval structures 22, 54 in each outer layer 61, 62 and in each inner layer 63, 64 mutually complete to a closed oval shape as depicted in FIG. 5 with the seam 24 as symmetry axis.

Furthermore, it may be beneficial to provide the outer panel 7 with a reinforcement structure 52. The structure of reinforcement 52 may be introduced simultaneous with the structural weakening 50. However, it may also be advantageous to introduce the structure of reinforcement 52 before the structural weakening 50 is applied to the endless sheet.

The structure of reinforcement 52 may be of arbitrary shape. It can be oval, circular, or may have a slit like geometry. Further, the structure of reinforcement 52 should be disposed or arranged at a distance from the lateral edge 66 of the fourfold portion 59. The distance between the structural weakening 50 and the lateral edge 66 defines the height of the first strap 14 in the final package. Hence, the lateral edge 66 corresponds to the upper edge 9 of the external panel 7. The structure of reinforcement 52 can be implemented in the external panel 7 by a pair wise joining or bonding of the inner layers 63, 64 with adjacent outer layers 61, 62 along the shape of the structure of reinforcement 52.

In detail with respect to FIG. 8, the outer layer 62 can be joined or bonded with its adjacent inner layer 64 by any kind of suitable joining or bonding means, such like ultrasonic bonding, thermal bonding or pressure bonding. Accordingly, the outer layer 61 is joined or bonded with the inner layer 63. However, the two inner layers 63, 64 are not joined or bonded to each other when introducing a structure of reinforcement. For instance, when applying ultrasonic-, thermal- or pressure bonding, it has to be ascertained, that the two inner layers 63, 64 remain separated from each other.

For a selective and systematic separation of the inner layers 63, 64, it is suggested that a separating means or a separating agent may be inserted or disposed between the inner layers before the outer layer 61 is bonded or joined with the adjacent inner layer 61 and when the outer layer 62 is bonded or joined with the inner layer 64 along the structure of reinforcement 52. Especially when thermal or ultrasonic bonding is applied for introducing the structure of reinforcement 52, it is advantageous to make use of heat resistant separating means, such as a heat resistant sheet which may optionally be the coated with a non-stick medium or with a non-stick coating.

In the illustrated embodiments, the structure of reinforcement 52 is of closed shape and the structural weakening 50 is adjacently arranged inside the structure of reinforcement 52. Typically, the gripping means 12 and the aperture 37 or the slit are surrounded by the structure of reinforcement 52. However, the structure of reinforcement 52 does not have to completely surround the structural weakening 50.

By introducing a structural weakening 50 into the fourfold portion 59 of two packages 55, 56 being consecutively arranged in machine direction 53, as illustrated in FIG. 6, the gripping means 12 can be introduced simultaneously into two flexible packages 55, 56.

The seam 24 intersects the structural weakening 50 and also the optional structure of reinforcement 52 and divides the gripping means 12 into two flap sections 22, 54, each of which being complied to a different package 55, 56. The flap section 22 and that portion of the structural weakening 50 being arranged left to the seam 24 in FIG. 6 form the gripping means 12 of a side wall 2 of the package 55. Correspondingly, the other flap section 54 and its structural weakening 50 form the gripping means 12 of another package 56. Hence, in the endless sheet, the structural weakening 50 of one package is in direct contact with the structural weakening 50 of the neighbouring package.

Due to the division of the structural weakening 50 by the seam 24, consecutive packages 55, 56 can be sealed and can subsequently be separated from each other. However, introduction of the seam 24 and the division of bonded layers extending towards the seam 24 can be executed in a common or combined step of manufacture. The position of the seam 24 in machine direction does not need to be absolutely precise but may vary within certain limits. For instance, if the oval structure 50 belonging to both packages 55, 56, as depicted in FIG. 6, is divided by the seam 24 in a dissimilar manner, the flap sections 22 and 54 will be different with regard to their extension in machine direction 53. Nevertheless, their shape may be symmetric with respect to the position of the seam 24. However, it has to be ensured that the gripping means 12 in each final package can still be conveniently gripped by the consumer.

Before the seam 24 is introduced into the material joining various layers 61, 62, 63, 64 and disassembling two adjacent packages 55, 56, a line of weakness 18, 19 may be introduced at least into the fourfold portion 59. Depending on the expansion of the line of weakness 18, 19, the line may also extend into the twofold portion 60, respectively. The line of weakness is introduced simultaneously in all layers 61, 62, 63, 64 of the fourfold portion 59 and twofold portion 60. The line of weakness 18, 19 substantially takes the same overlaying shape in all these layers 61, 62, 63, 64.

The line of weakness 18, 19 extends through the optional structure of reinforcement 52 and extends at least to the edge of the structural weakening 50. After seaming and disassembling adjacently manufactured packages 55, 56 along the seam 24 and after filling the package 1, 55, 56 with articles 33, 34, the first 18 and second portions 19 of the line of weakness 18 become apparent, both extending into the structural weakening 50 and optionally traversing the structure of reinforcement 52, as depicted in FIG. 5.

FIG. 7 schematically illustrates the two packages 55, 56 of FIG. 6, when not bonded or joined along the seam 24 but when unfolded with respect to the fold lines 57 and 58.

The two outer sections 62 and 61 correspond to the two outer layers of FIG. 8, whereas the inner sections 63 and 64 correspond to the two inner layers. For the process as described above, the illustration of FIG. 7 is only exemplary for illustration purpose. In real life situation, the reinforcement structures 52 of the layer 62 and 64 are joined to each other and the corresponding reinforcement structures 52 of layers 61 and 63 are joined or bonded, respectively.

The line of weakness with its first, second and third sections 18, 19, 47 is symmetrically present in the two outer layers 61, 62 (having the first and second portions) as well as in the two inner layers 63, 64 (having the third portion). When the layers 61, 62, 63, 64 are bonded along the structure of reinforcement 52, the first portion 18 and the second portion 19 of the line of weakness are connected by the third portion 47 of the line of weakness being arranged in the inner layers 63, 64.

In the example of FIG. 6, the line of weakness traverses the fold line 57. Insofar, in the fourfold portion 59 only the first section 18, 19 and the curvature or bend 41, 42 and a small part of the second section of the line of weakness are introduced. The lower section 43, 44 of the line of weakness is mainly disposed in the twofold portion 60. The third portion 47 of the line of weakness is not visible in FIG. 6 as this portion is comprised by the inner layers 63, 64. Also, the second portion of the line of weakness is not visible in FIG. 6, as it is comprised by the outer layer, which is not visible in FIG. 6.

Figure 2:
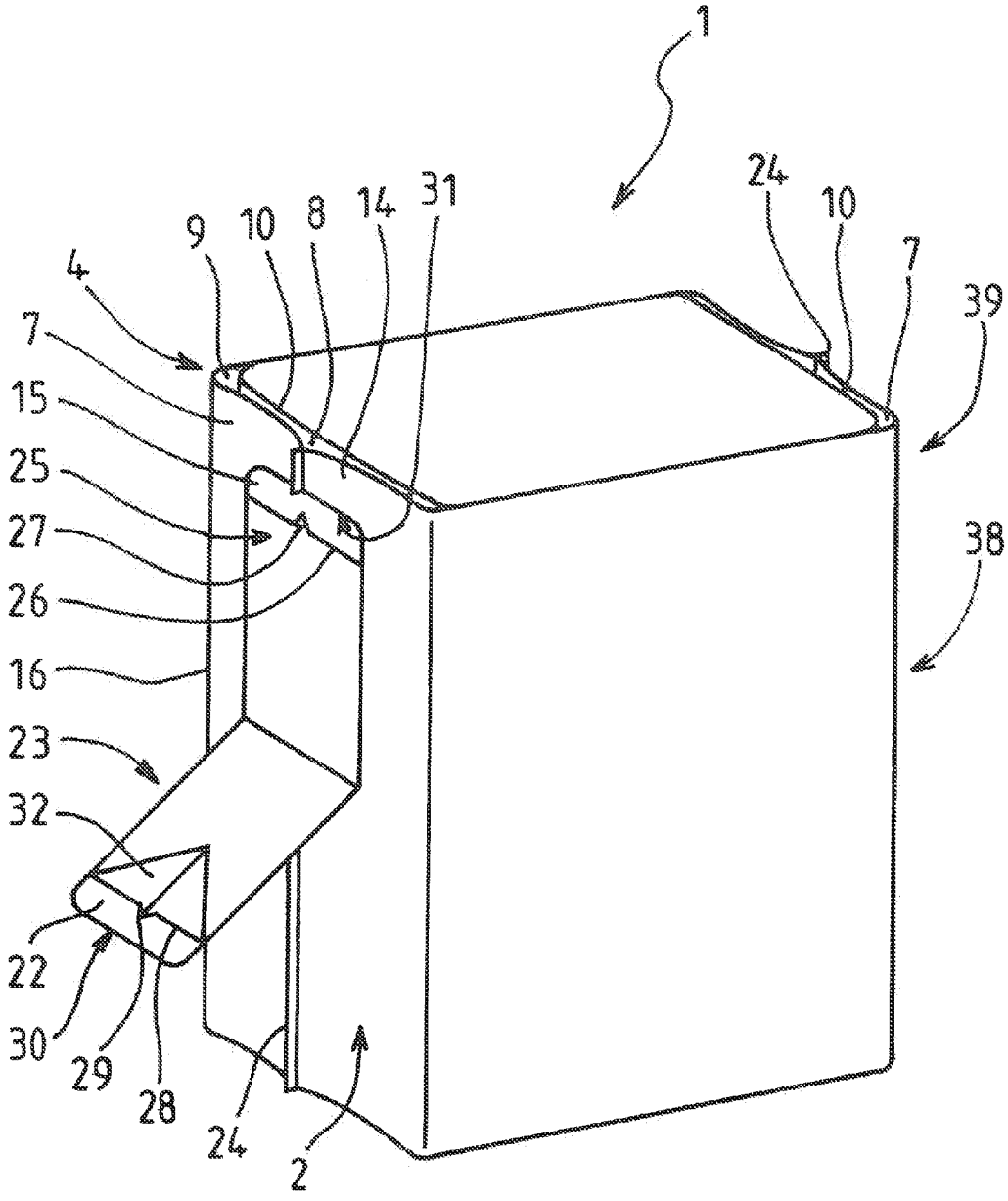
FIG. 2 in a perspective view, the package of FIG. 1, with the side wall opened.

In FIG. 7, the first, second and third portions 47 of the line of weakness are apparent. Furthermore, the bend or curvature 41, 42 illustrated in FIGS. 3, 4 and 6 transforms into a peak portion 29 upon filling the package 1 with articles 33, 34. The peak portion 29 is part of the gripping means 12 and belongs to the tear-off portion 23, as illustrated in FIG. 2. In the closed configuration, the peak portion 29 is adjacent to a notch 27 being arranged in the central part of the lower edge 26 of the second strap 15. The peak portion 29 of the tear-off portion 29 and the notch 27 arranged at the lower edge 26 of the second strap correspond to each other. The notch 27 and the peak portion 29 are disposed in the two inner layers 63, 64. Before an opening of the package 1, the peak portion 29 and the notch 27 are adjacent to one another but they are divided from each other upon opening of the package 1, hence by tearing away the tear-off portion 23 and by breaking the third section of the line of weakness 47.

Due to the M-shaped fold of the sheet, the notch 27 and the peak portion 29 correspond to the bend or curvature 41, 42 connecting upper and lower portion of the first and second portions 18, 19 of the line of weakness. The shape of the bend or curvature 41, 42 and consequently the shape and geometry of the two corresponding peak portion 29 and notch portion 26 specify a threshold for the tearing force that has to be exerted by the user in order to open the package 1. In a locked or closed configuration, the lower edge 26 of the second strap 15 and the upper edge 30 of the pocket portion 32 are connected to each other along the third portion 47 of the line of weakness. By providing the peak portion 29 and the corresponding notch 27 with a certain slope with respect to the residual or remaining section of the third portion of the line of weakness 47, the pull-off-force required to open the package 1 and to break the line of weakness 47 can be advantageously enhanced. In this manner, the opening means 3 can be advantageously secured against inadvertent opening of the package.

In FIG. 7 the fold lines 20, 21 shown in FIG. 5 are projected in the planar inner layers 63 and 64 for explanation purpose. These fold lines 20, 21 may form an angle of 40° to 50°, or of 45° with respect to the seam 45 and/or with respect to the fold lines 57, 58.

The fold lines 20, 21 define the size and shape off the gusset 6. In particular, the area within the inner layers 63, 64, which is surrounded by the fold lines 20, 21 and the line 67 corresponds to the side of the triangle as seen in FIG. 5 being confined by the fold lines 20, 21 and by the upper edge 4 of the side wall 2. Consequently, the line 67 as shown in FIG. 7 corresponds to the upper edge 10 of the internal panel, when the package is filled with articles 33, 34 and resumes its final shape.

The area confined by the line 67, the two fold lines 20 and 21 and by the third portion 47 of the line of weakness forms the second strap 15. The remaining portion of the triangle shaped section, which is confined by the two fold lines 20 and 21 and by the third portion of the line of weakness 47 forms the pocket portion 32 as being visible in FIG. 2.

Figure 3:
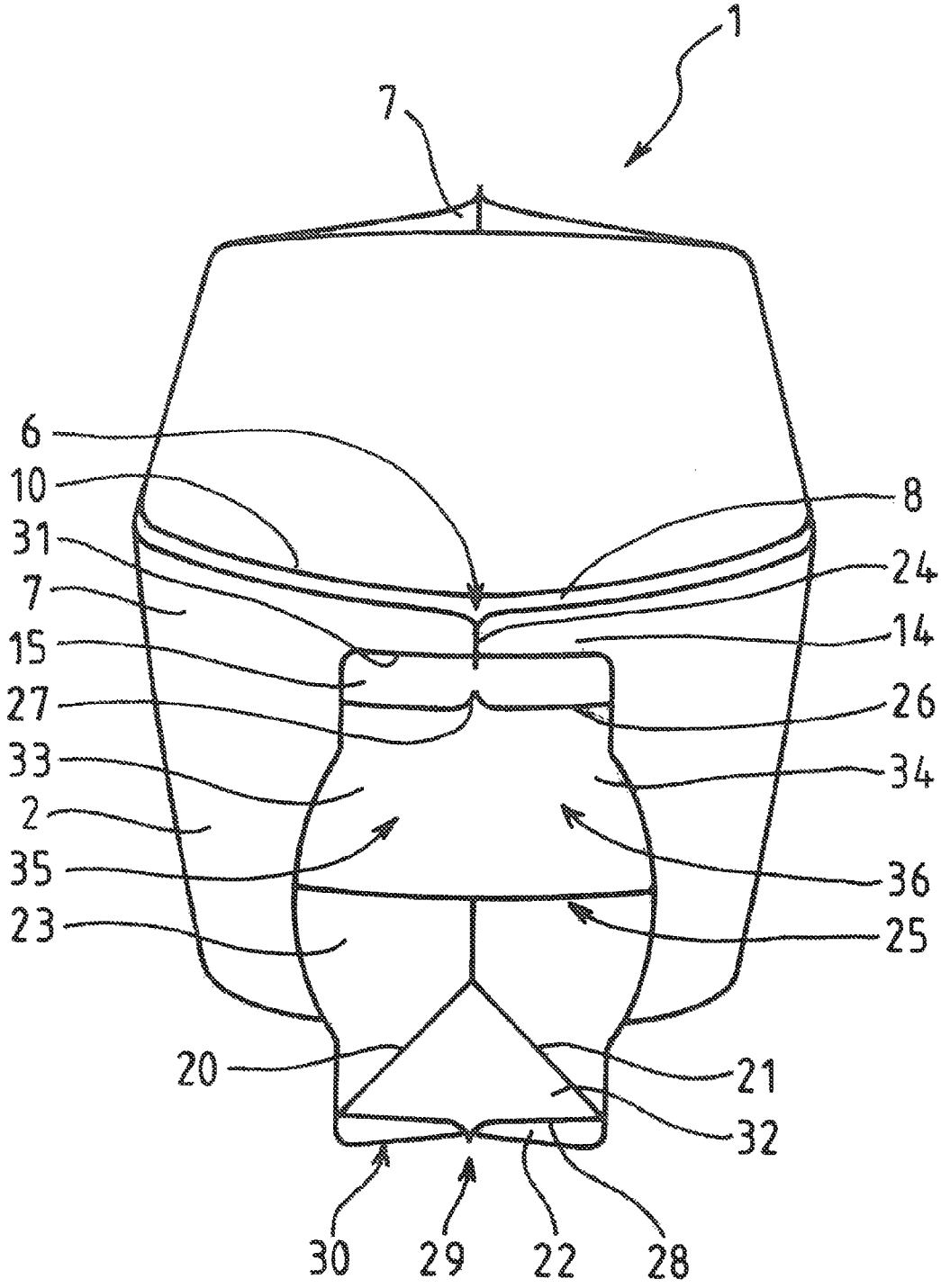
FIG. 3 in a perspective view, another embodiment of the package comprising two rows of diapers and having a line of weakness gradually widening along the tearing-off direction.

The pocket portion 32 comprising the triangular shaped tip of the pocket, is further illustrated in FIG. 3. There, the opening 25 has been formed by tearing-off the tearing means 11, in particular the tear-off portion 23 along the tear-off direction 13, thereby disrupting the line of weakness 18, 19, 47, being typically designed as a perforation.

Upon filling of the package 1, the two inner layers 63, 64 are folded along the fold lines 20, 21. As a consequence the two outer layers 61, 62 separate from each other in such a way, that the inner layers 45, 46 form the top wall of the package and the pocket of the gusset 6. The shape and dimension of the structural weakening 50 and optionally the structure of reinforcement 52 should be chosen in such a way, that it does not intersect with the fold lines 20, 21. Otherwise an opening of the package 1 might be hindered. It is hence suggested, that the distance between the structural weakening 50 and the fold lines 20, 21 is at least 2 mm, or at least 4 mm, or at least 5 mm.

In contrast to the way of manufacture described above and illustrated by the M-shaped fold according to FIG. 6, the package 1 may also be manufactured in an alternative way. Hence, instead of an M-shaped fold as depicted in FIG. 8, one may start from an unfolded endless sheet running in machine direction 53 as illustrated in FIG. 7. Here, the various structural weakenings 50 of the portions 62, 64, 63, 61 of the endless sheet are not introduced in an overlaying manner but at different locations with respect to the cross machine direction either simultaneously or consecutively in time. While reference numerals 62, 64, 63, 61 refer to various overlapping layers, with respect to this alternative way of production they indicate corresponding portions of the endless unfolded sheet that become overlapping layers later on, when folded along various fold lines 57, 58.

Together with imprinting or introducing the structural weakening 50, also the various portions and sections of a line of weakness 18, 43, 47, 27, 19, 44 may be introduced or imprinted into the endless sheet. The various portions of the line of weakness 18, 43, 47, 27, 19, 44 may be imprinted or introduced in a timely and/or spatially separated manner. This allows to introduce or to imprint the various portions and sections 18, 43, 47, 27, 19, 44 in a universal, independent and versatile way. Consequently, the flexibility regarding the shape of the tear-off portion 23 as defined by the shape and geometry of the various portions and sections of the line of weakness 18, 43, 47, 27, 19, 44 is improved, e.g. the shape may also become asymmetric. In detail, the portion 18 and the portion 19 may differ in extension, elongation, orientation and with respect to their overall shape. While the same may also apply to the first and second sections 18, 19, 43, 44 of the line of weakness, the overall shape of the tear-off portion 23 can be designed with great flexibility, e.g. to comply with consumer requests.

Introduction or imprinting of the various portions and sections 18, 43, 47, 27, 19, 44 of the line of weakness in a non-overlaying manner especially allows varying the shape and elongation of the third portion of the line of weakness 47 in a desired way. In effect, the shape of the third portion 47 of the line of weakness no longer has to be correlated to the shape of the first and/or second portions 18, 19 of the line of weakness but can be chosen independently.

However, the various portions and sections of the line of weakness 18, 43, 47, 27, 19, 44 have to fulfil the constraint, that they merge or extend into the structural weakening 50 and into the optional structure of reinforcement 52 in such a way, that the various portions 18, 19, 47 of the line of weakness may mechanically interact during a tear-off procedure upon opening of the package 1. Hence, it has to be ensured, that after the beginning of a tear-off and opening procedure, which comes along with an initial disruption of the third portion of the line of weakness 47, a subsequent disruption of those portions 18, 19, namely first and second portions of the line of weakness being connected with the portion of the line of weakness occurs. Since the various portions 18, 19, 47 of the line of weakness are arranged in different layers 61, 62, 63, 64, for opening convenience, it may be beneficial, to bond each of the outer portions 61, 62 with its adjacent inner layer 64, 63 at least in that region, in which the respective portions 18, 19, 47 of the line of weakness extend into the structural weakening 50 or into the structure of reinforcement. Typically, the structure of reinforcement 52 may serve as a bonding means for the outer 61, 62 and inner layers 63, 64.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Flexible package for accommodating a multiplicity of articles, the package comprising at least a side wall having a side seam, the side wall having further an upper edge and a lower edge, wherein at least one gusset is formed in the side wall, the at least one gusset comprising an internal panel being covered by an external panel, the external panel comprising an upper edge lying adjacent the upper edge of the side wall, wherein the upper edge of the external panel extends over the whole width of the side wall;

wherein the side wall comprises an aperture through the external panel of the gusset, the aperture being bounded by an aperture edge, the aperture edge having an upper portion spaced downwardly apart from said upper edge of said external panel, a pair of spaced-apart lines of weakness in said side wall, each line of weakness beginning at the aperture edge and extending downward from the aperture edge toward said lower edge, said lines of weakness defining a tearaway portion of the side wall, the tearaway portion comprising a lower portion of the aperture edge;

wherein the lines of weakness and the tearaway portion are adapted to create an opening in the side wall by tearing away of the tearaway portion in a direction toward said lower edge, wherein one or more articles from the multiplicity of articles can be removed from the package through the opening, wherein the side wall further comprises a first strap defined in part by said upper edge of said external panel and said upper portion of said aperture edge, and a second strap comprising a portion of the internal panel, the first and second straps remaining substantially in place relative to the side wall when the tearaway portion is torn away.

2. Package according to claim 1, wherein the aperture comprises a slit formed through the external panel.

3. Package according to claim 1, further comprising a third line of weakness extending within the gusset and connecting the pair of lines of weakness.

4. Package according to claim 1, wherein the pair of lines of weakness have portions that are not parallel as they extend downwardly.

5. Package according to claim 4, wherein the lines of weakness extend toward or away from each other along a curvature or a bend.

6. Package according to claim 3, wherein the third line of weakness is arranged inside the gusset in a portion of the internal panel.

7. Package according to claim 1, wherein the external panel comprises an inner layer and an outer layer and wherein the inner and outer layer are joined to each other at least partially along the upper portion of the aperture edge.

8. Package according to claim 1, wherein a second side wall, opposite to the side wall, comprises a second aperture therethrough, the second aperture being bounded by a second aperture edge, the second aperture edge having an upper portion spaced downwardly apart from an upper edge of a second external panel.

9. An approximately rectangular flexible package containing a plurality of articles, the package being formed of a thermoplastic material and having a pair of opposing side walls, each of the side walls being defined by four corner edges comprising two opposing pairs of respective top and bottom edges and respective side edges, the package also comprising:

an aperture through at least one of the side walls, the aperture being bounded by an aperture edge, the aperture edge having an upper portion spaced downwardly apart from the top edge defining said at least one of the side walls;

a pair of lines of weakness in said at least one of the side walls, each line of weakness beginning at the aperture edge and extending downward from the aperture edge toward the bottom edge of said at least one of the side walls, said lines of weakness defining a tearaway portion of said at least one of the side walls, the tearaway portion comprising a lower portion of the aperture edge; and first and second straps each defined in part by the upper portion of the aperture edge and each comprising a portion of the at least one of the side walls, the first and second straps remaining substantially in place relative to the at least one of the side walls when the tearaway portion is torn away;

wherein said lines of weakness do not extend upward from said aperture edge toward the top edge defining said at least one of the side walls.

* * * * *